US009357830B2

(12) United States Patent
Merzon

(10) Patent No.: US 9,357,830 B2
(45) Date of Patent: Jun. 7, 2016

(54) BELT HANGER FOR HANDHELD DEVICE

(71) Applicant: Richard H. Merzon, Far Hills, NJ (US)

(72) Inventor: Richard H. Merzon, Far Hills, NJ (US)

( * ) Notice: Subject to any disclaimer, the term of this patent is extended or adjusted under 35 U.S.C. 154(b) by 0 days.

(21) Appl. No.: 14/465,878

(22) Filed: Aug. 22, 2014

(65) Prior Publication Data

US 2016/0051039 A1 Feb. 25, 2016

(51) Int. Cl.
*A45F 5/02* (2006.01)

(52) U.S. Cl.
CPC ..... *A45F 5/021* (2013.01)

(58) Field of Classification Search
CPC ..... A45F 5/021
USPC ..... 224/269, 197, 660, 663, 665–668, 224/671–675
See application file for complete search history.

(56) References Cited

U.S. PATENT DOCUMENTS 5,174,482 A * 12/1992 Rogers ..... F42B 39/02 221/185

* cited by examiner

*Primary Examiner* — Corey Skurdal
(74) *Attorney, Agent, or Firm* — R. Tracy crump

(57) ABSTRACT

A belt hanger detachably supports the handheld device, whether or not carried in a pouch or holster, to a wearer's waist belt to comfortably and securely carry the device while preventing the device from sagging and hanging outward from the wearer's body. The belt hanger includes a rigid hanger body, a flexible strap cover and a quick connector part, which couples directly to the handheld device or its carry pouch or holster. The hanger body has a rectangular shape and a central belt channel for receiving the user's waist belt. The cover strap is bonded to the hanger body and wraps over the hanger body so that one end covers one its faces and the opposite loose end extends over the belt channel and its other face to act as the closure strap for belt hanger. The opposite loose end of the cover strap is secured to the hanger body by a pair of snaps.

6 Claims, 7 Drawing Sheets

BELT HANGER FOR HANDHELD DEVICE

This invention relates to a belt hanger for carrying hand held devices, such as radio, GPS and phones.

BACKGROUND AND SUMMARY OF THE INVENTION

Handheld electronic devices, such as cell phones, police or EMS radios and GPS devices are often carried on the user's belt using specialized quick connected mechanisms mounted to a belt hanger. The specialized quick connect mechanisms for such devices are common and well known in the industry, and heretofore the belt hangers have been simply a leather strap folded over itself and secured by metal snaps. The specialized quick connect mechanism allows the handheld device to be securely coupled to and quickly uncoupled from the belt hanger for ease of use, while allowing for the handheld device to rotate, but not swing freely held by an internal spring about the belt hanger for comfortable carrying. However, the belt hangers tend to allow the handheld device, particularly radios, to sag and hang outward away from the user's body as shown in FIG. 1. Typically, this sag is caused by slack in the leather straps when worn on the belt.

The belt hanger of this invention detachably supports the handheld device, whether or not carried in a pouch or holster, on a wearer's waist belt to comfortably and securely carry the device while preventing the device from sagging and hanging outward from the wearer's body. The belt hanger includes a rigid hanger body, a flexible strap cover and a quick connector part, which couples directly to the handheld device or its carry pouch or holster. The hanger body has a rectangular shape and a central belt channel for receiving the user's waist belt. The cover strap is bonded to the hanger body and wraps over the hanger body so that one end covers one of its faces and the opposite loose end extends over the belt channel and its other face to act as the closure strap for the belt hanger. The opposite loose end of the cover strap is secured to the hanger body by a pair of snaps. When donned, the wearer's belt seats snugly within the belt channel and is sandwiched between the hanger body and the cover strap. The rigidity of the hanger body along with tightly sandwiching the wearer's belt between the hanger body and the cover strap holds the belt hanger flat and snug against the wearer's belt and prevents the handheld device and its carry pouch or holster from snagging or extending outward from the user.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration, specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The drawings illustrate several different embodiments of the belt hanger of this invention. Each embodiment of the belt hanger includes a rigid hanger body and a flexible cover strap and are similarly constructed. Each embodiment of the belt hanger of this invention detachably secures and carries a handheld device or the holster or carry pouch for a handheld device to a waist belt worn by a user. Moreover, each embodiment of the belt hanger is designed and intended to hold the device close to the user's body and prevent the device from sagging or hanging outward from the wearer's body. For simplicity of illustration, the belt hangers are illustrated with a radio 10 carried in a conventional radio holster 20, which is detachably coupled to the belt hanger using a quick connect mechanism. The belt hanger can be adapted for use with a particular handheld device, holster or carry pouch, as desired.

Figure 1:
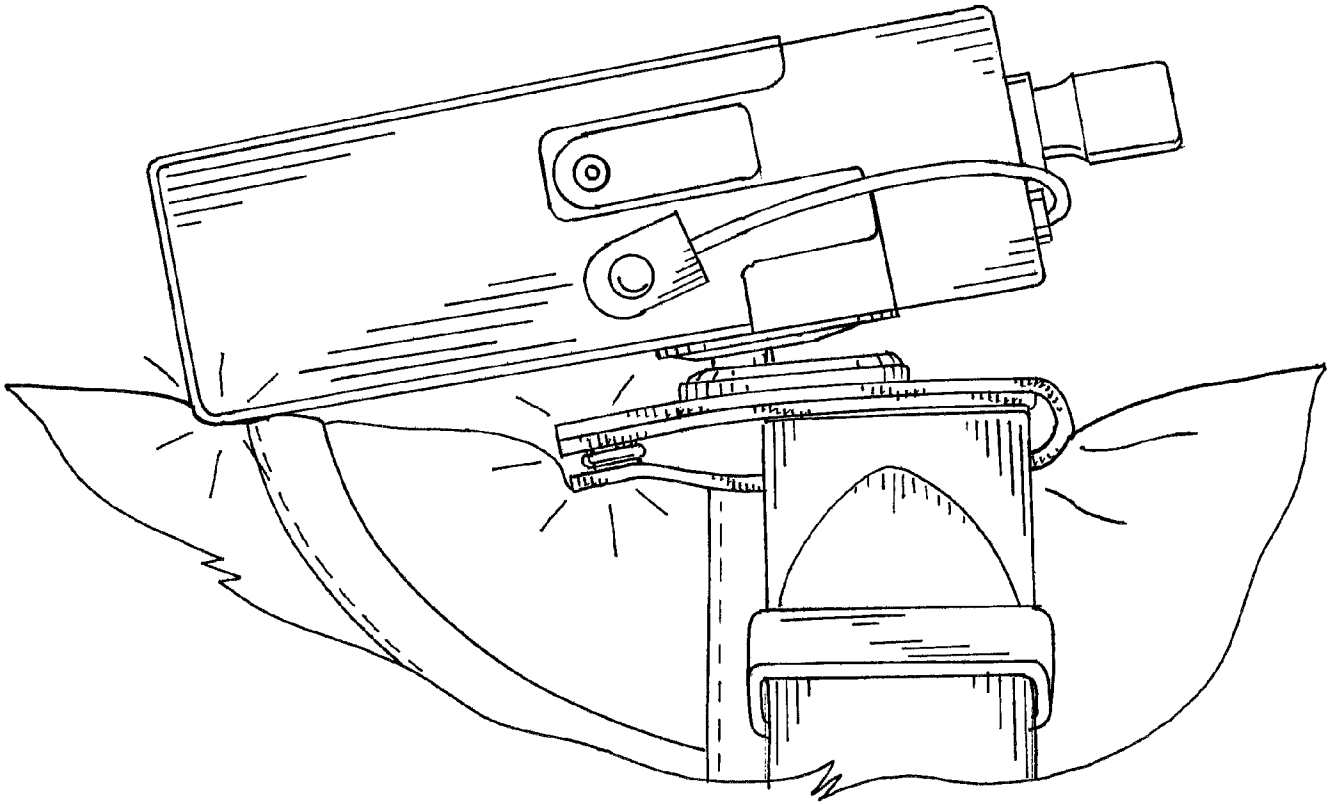
FIG. 1 PRIOR ART
FIG. 1 is a side view of a conventional belt hanger for a radio holster shown worn on a duty belt, which shows an example of the prior art.
Figure 2:
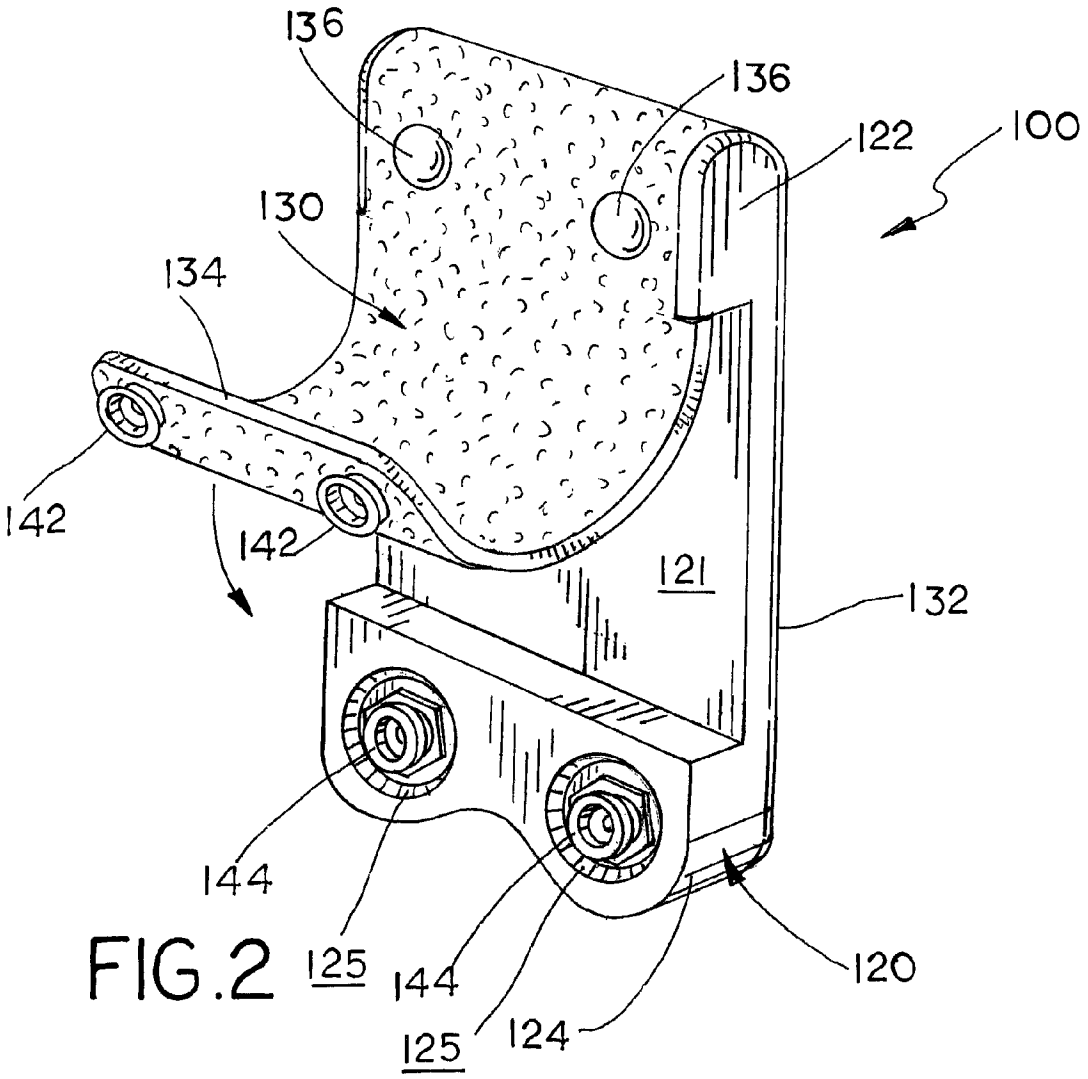
FIG. 2 is a perspective view of an embodiment of the belt hanger of this invention.
Figure 4:
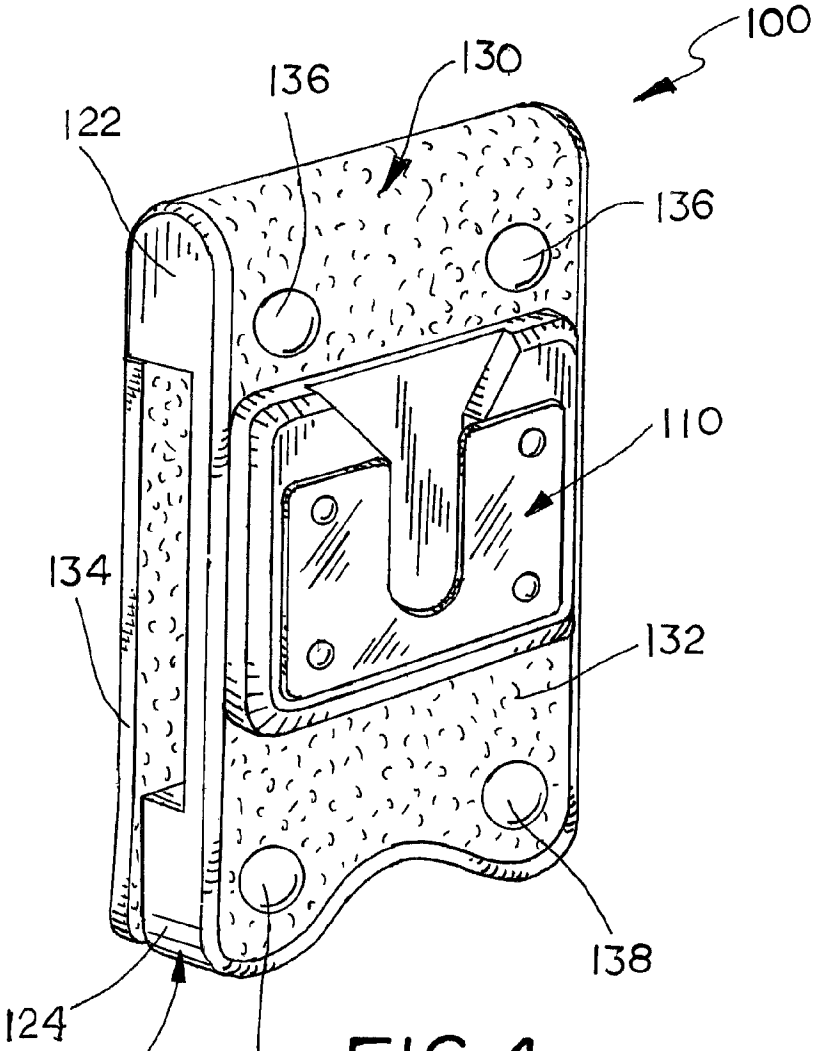
FIG. 4 is a rear perspective view of the belt hanger of FIG. 2.
Figure 3:
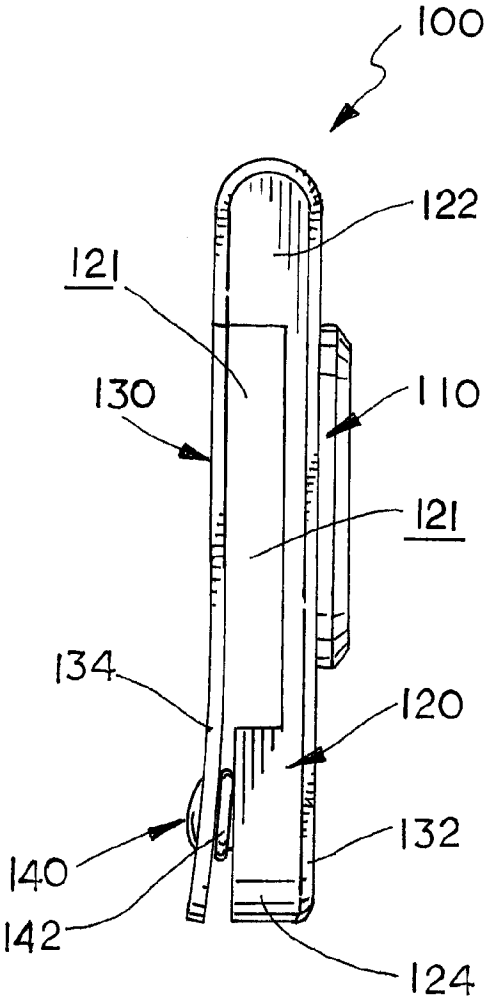
FIG. 3 is a side view of the belt hanger of FIG. 2.
Figure 6:
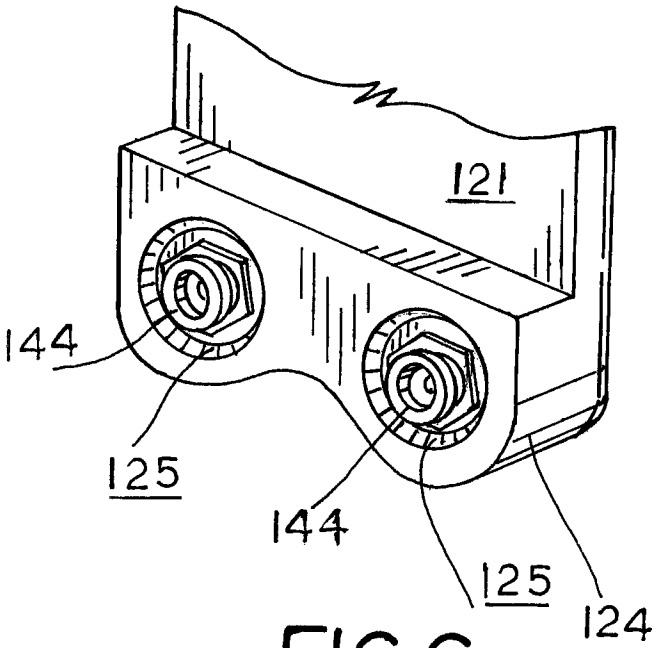
FIG. 6 is a perspective view of the lower portion of the belt hanger of FIG. 2.
Figure 5:
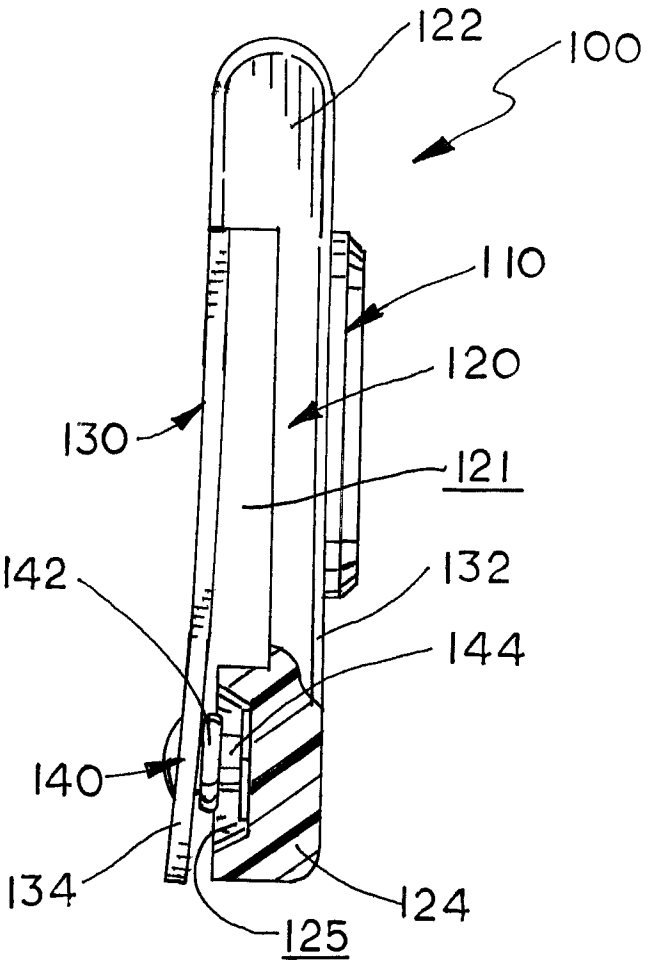
FIG. 5 is a partial side sectional view of the belt hanger of FIG. 2.
Figure 7:
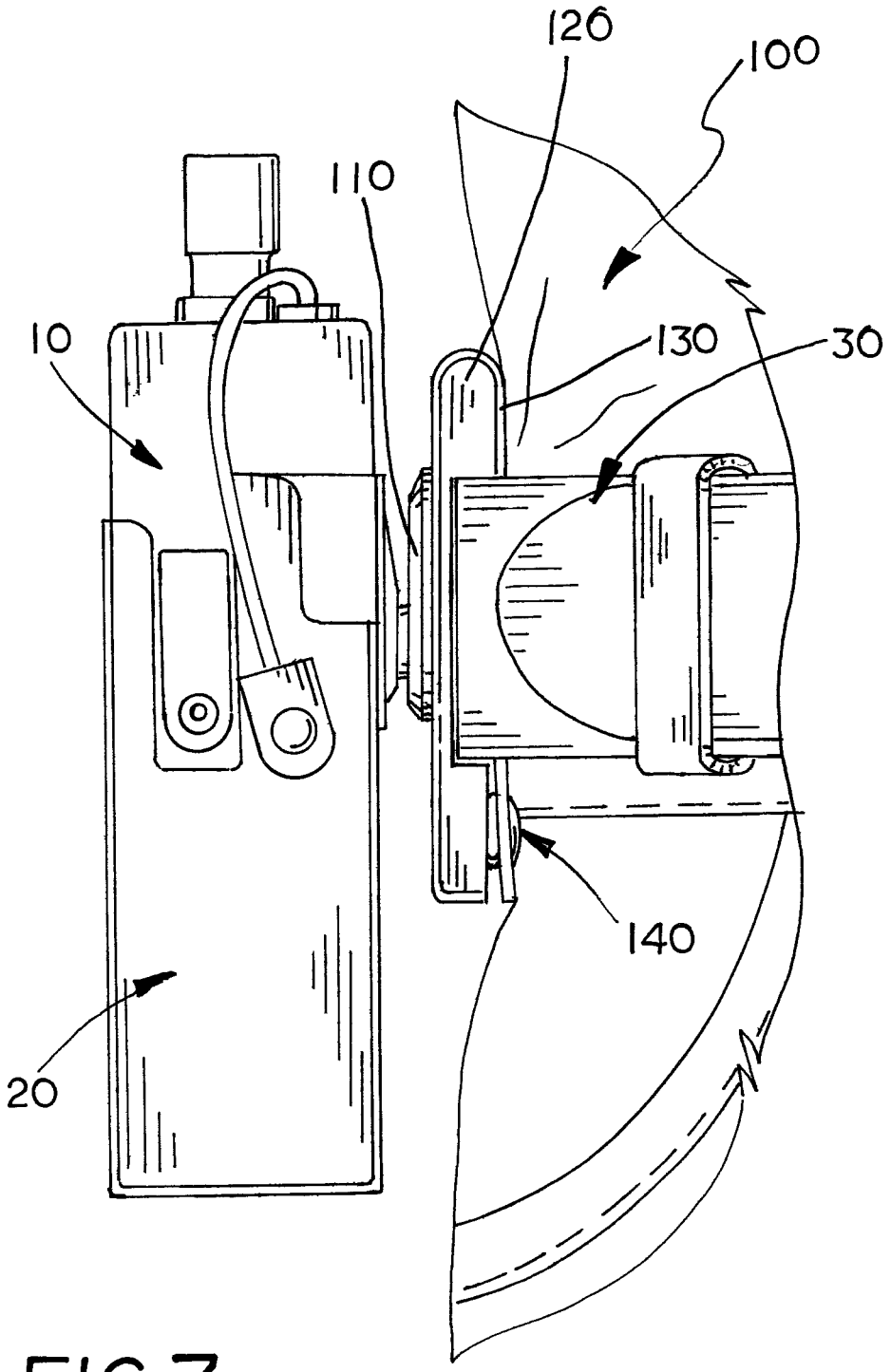
FIG. 7 is a side view of the belt hanger of FIG. 2 shown worn on a user's belt and supporting a conventional radio holster and radio.
Figure 9:
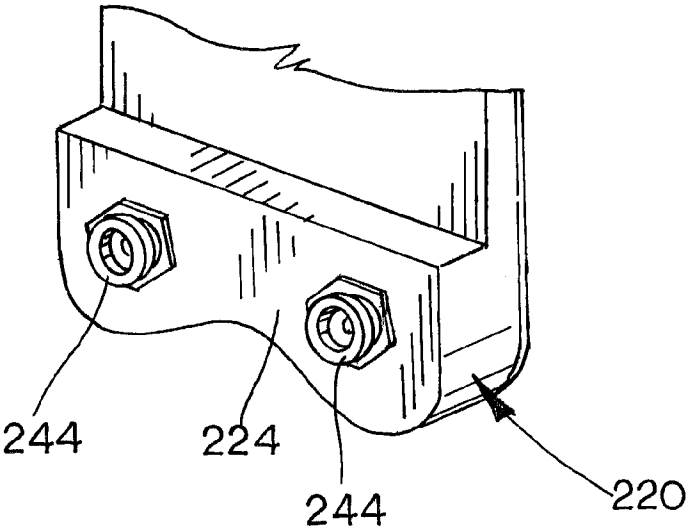
FIG. 9 is a perspective view of the lower portion of the belt hanger of FIG. 8.
Figure 8:
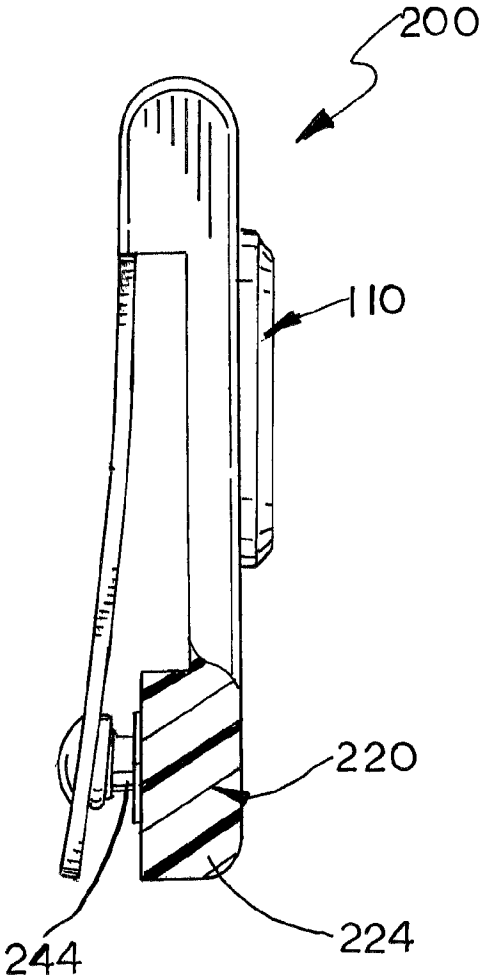
FIG. 8 is a partial side view of another embodiment of the belt hanger of this invention.
Figure 11:
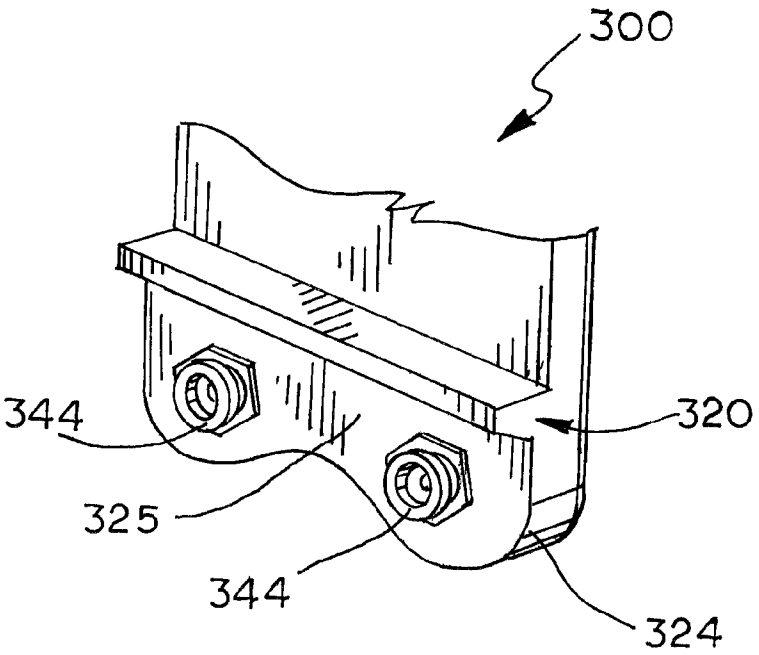
FIG. 11 is a perspective view of the lower portion of the belt hanger of FIG. 8.
Figure 10:
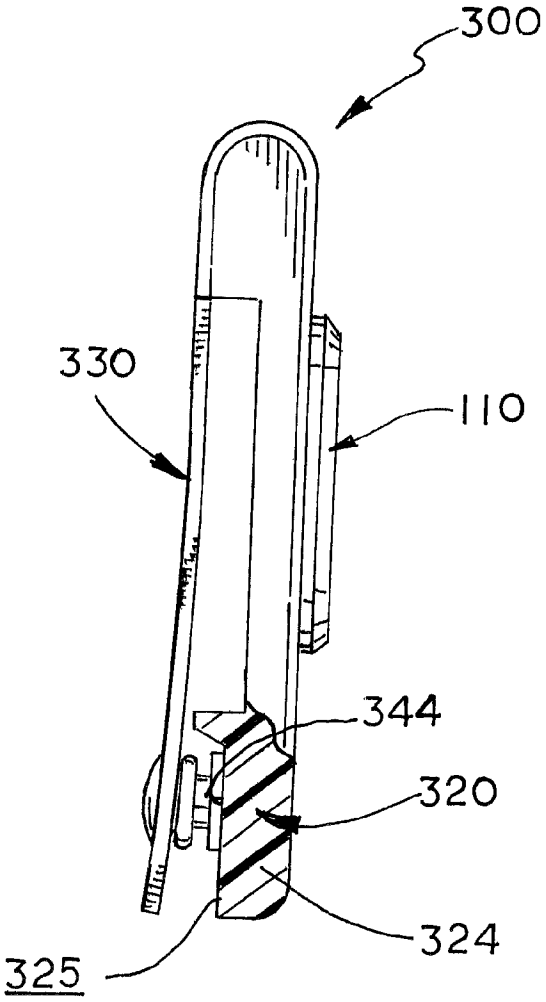
FIG. 10 is a partial side view of a third embodiment of the belt hanger of this invention.

Referring now to the drawings, FIGS. 1-7 illustrate an embodiment of the belt hanger of this invention, which is designated generally as reference numeral 100. Belt hanger 100 has a rigid hanger body 120, a flexible strap cover 130 and a quick connector plate 110. Connector plate 110 receives and securely couples with a complimentary connector, which can be affixed directly to the handheld device or its carry pouch or holster (as shown in FIG. 7). Both connector plate 110 and its complimentary connector are well known and commonly used in the industry.

Hanger body 120 is formed, molded or otherwise constructed of a suitable polymer plastic or other suitable material. The polymer construction of the hanger body affords belt hanger 100 the necessary rigidity to support the weight of the handheld device carried by the belt hanger and hold the device close to the user's body. Hanger body 120 has a generally rectangular shape and a central belt channel 121, which is formed laterally across the rear face (with respect to the orientation of the belt hanger to the wearer) of the hanger body. Belt channel 121 is rectangular as dimensioned to receive the width and thickness of a conventional duty belt, but may be configured to accommodate any particular belt width or thickness. The top 122 of hanger body 120 has a rounded end wall that curves over from the front to the back of the hanger body. The bottom 124 of hanger body 120 has a substantially flat end wall with a curved central depression and a pair of depressions 125 formed in its rear face.

Cover strap 130 is typically a tanned leather, vinyl or similar synthetic material cut or formed. Cover strap 130 is bonded to hanger body 120 by an adhesive and further secured by two sets of rivets 136 and 138. As shown, cover strap 130 wraps over hanger body 120 so that one end 132 of cover strap 130 covers the front face of the hanger body and the opposite end 134 extends over belt channel 121 and the rear face of the hanger body to act as the closure strap for belt hanger 100. End 134 of cover strap 130 is detachably secured to bottom 124 of hanger body 120 by a pair of button snap connectors 140. Snap connectors 140 are of conventional design and include female parts 142 mounted to end 134 of strap cover 130 and male parts 144 that are seated within depressions 125 and secured by rivets 138. Alternatively, snap connectors 140 may take the form of other suitable fastener, such as heavy duty, three sided locking snap fastener that is designed to withstand extreme pressure on three sides without unlocking, such as those available from GSG Fastener, LLC. Of Clarkesville, Ga.

As shown in FIG. 7, belt hanger 100 is fitted to a user's belt 30. To don belt hanger 100 to belt 30, end 134 of cover straps 130 is slid under the belt and connected to hanger body 120 by snaps 140. When donned, belt 30 seats snugly within belt channel 121 and is sandwiched between the hanger body and cover strap 130. It should be noted that cover strap 130 lays flatly over and against belt 30 when fastened. Consequently, the rigidity of hanger body 120 and straight tight abutment of cover strap 130 holds belt hanger 100 flat and snug against belt 30 and prevents handheld device 10 and holster 20 from snagging or extending outward from the user.

FIGS. 8-11 show two additional embodiments of the belt hanger of the present invention, which are designated as reference numeral 200 and 300, respectively. Both belt hangers 200 and 300 are similar to belt hanger 100 in design, construction and function. Belt hanger 200 differs from belt hanger 100 in that male snap parts 244 are flush mounted to the rear face of bottom 224 of hanger body 220. Belt hanger 300 differs from belt hanger 100 in that the bottom 324 of hanger body 320 has a recessed face 325 to which male snap parts 344 are mounted.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A belt hanger for supporting a handheld device on a waist belt, the belt hanger comprising:

a flat rigid hanger body, the hanger body having a top end, a bottom end opposite the top end, a first surface, a second surface opposite the first surface, and a recessed channel formed across the first surface between the top end and the bottom end, the channel configured to receive the waist belt longitudinally therein;

a flexible cover strap having a first end affixed to the hanger body and a second end extending from the hanger body to overlie the channel and the first surface, the first end of the cover strap overlies the second surface of the hanger body and the top end of the hanger body;

fastener means affixed to at least one of the second end of the cover strap and the first surface of the hanger body for detachably connecting the second end of the cover strap to the first surface of the hanger body;

coupling means mounted to the second surface of the hanger body for detachably connecting the handheld device to the hanger body.

2. The belt hanger of claim 1 wherein the second end of the cover strap lays flat against the waist belt when the second end of the cover strap is connected to the first surface of the hanger body.

3. The belt hanger of claim 1 wherein the fastener means is a snap.

4. The belt hanger of claim 1 wherein the hanger body is constructed of a polymer plastic.

5. The belt hanger of claim 1 wherein the cover strap is made of leather.

6. The belt hanger of claim 1 wherein the first surface of the hanger body has a recessed area defined therein adjacent the bottom end, the fastener means disposed within the recessed opening.

* * * * *